US006112501A

United States Patent [19]

Pollock

[11] Patent Number: 6,112,501

[45] Date of Patent: Sep. 5, 2000

[54] BULK PARTICULATE PACKAGING SYSTEM

[76] Inventor: John Pollock, 24432 Pressonville Rd., Wellsville, Kans. 66092

[21] Appl. No.: 09/159,343

[22] Filed: Sep. 23, 1998

Related U.S. Application Data

[63] Continuation-in-part of application No. 08/907,108, Aug. 6, 1997, Pat. No. 5,943,846.

[51] Int. Cl.[7] ..... B65B 63/02

[52] U.S. Cl. ..... 53/399; 53/439; 53/529; 53/586; 53/228; 100/218

[58] Field of Search ..... 53/439, 529, 228, 53/466, 399, 586, 530; 100/218, 127

[56] References Cited

U.S. PATENT DOCUMENTS

| | | | |
|---|---|---|---|
| Re. 31,944 | 7/1985 | Stromberg | 53/529 X |
| 3,117,513 | 1/1964 | Burnett et al. | 53/529 |
| 3,327,449 | 6/1967 | Hullhorst et al. | 53/529 X |
| 3,377,945 | 4/1968 | Davis | 100/127 |
| 3,824,758 | 7/1974 | Hart et al. | 100/218 X |
| 4,292,786 | 10/1981 | Long et al. . | |
| 4,779,402 | 10/1988 | Duynhoven et al. . | |
| 4,965,986 | 10/1990 | Klinkel . | |
| 5,046,258 | 9/1991 | Cahill et al. | 53/228 X |
| 5,058,634 | 10/1991 | Tisma . | |
| 5,125,210 | 6/1992 | Lang et al. | 53/529 |
| 5,172,629 | 12/1992 | Merry . | |
| 5,220,768 | 6/1993 | Aarts . | |
| 5,226,269 | 7/1993 | Stoltenberg . | |
| 5,406,774 | 4/1995 | Dodge . | |
| 5,459,982 | 10/1995 | Long . | |
| 5,694,742 | 12/1997 | Elliott et al. | 100/218 X |

*Primary Examiner*—Linda Johnson
*Attorney, Agent, or Firm*—Dale J. Ream

[57] ABSTRACT

A system for forming and packaging a bulk of loose particulate material. The system utilizes a compression tower for initial deposit of the loose particulate material therein with the bottom floor of said tower being presented by a belt of a conveyor system. A ram within the tower compresses the loose material into a bulk form atop the conveyor belt. Subsequent to compression, the conveyor system is vertically displaced so that the formed material bulk can be conveyed to a horizontally adjacent conveyor for downstream conveyance to a packaging station having upper and lower conveyor assemblies. The material bulk is then recompressed and conveyed to a space formed between upper and lower assemblies. A sheet of packaging material spans portions of upper and lower conveyor assemblies such that the material bulk is directed through the sheet and enveloped thereby for transfer to downstream upper and lower conveyor assemblies to maintain compression thereon. The downstream conveyor assemblies are longitudinally shiftable to vary the gap between the conveyor assemblies and minimize bulk decompression during transfer. Packaging material which envelops the bulk material is cut and thermally sealed, leaving the packaging sheet spanning the conveyor assemblies. The system diminishes the dislodgment of the particulate material from the bulk subsequent to its formation.

18 Claims, 17 Drawing Sheets

BULK PARTICULATE PACKAGING SYSTEM

CROSS REFERENCE TO RELATED APPLICATION

This application is a continuation-in-part of application Ser. No. 08/907,108 filed on Aug. 6, 1997 incorporated herein, now U.S. Pat. No. 5,943,846.

BACKGROUND OF THE INVENTION

This invention pertains to a packaging system and more particularly to a system for forming particulate material into a desired bulk shape and packaging the material bulk with minimal material loss and/or fibrous lumps.

Various devices have been proposed for shaping and packaging particulate matter into a bulk form. Certain devices first compress the material into a bulk form and then ram-direct the bulk into a preformed plastic bag. One problem with these devices is that the movement of the material bulk from one station to the other dislodges portions of the material from the previously shaped bulk, particularly at the corners thereof. This material separation can occur during ram induced transport particularly when directed through a downstream chamber such that friction arises. The resulting friction dislodges particulates from the material bulk, particularly at the corners thereof as well as forms fibrous lumps of material. The latter condition occurs as the friction directs the particulate matter in a direction opposite the direction of travel of the material bulk. Such actions cause an uneven material bulk, which precludes easy palletization, and causes unnecessary waste of the particulate material.

A similar problem occurs where a material bulk is permitted to rebound in the direction of compression prior to packaging. Palletization becomes difficult where one or more dimensions of the material bulk exhibit a non-uniform size when packaged.

Another problem is that the material bulk had to be deposited in a bag which requires additional bag production, material and labor costs and possible particulate dislodgment during bagging.

SUMMARY OF THE INVENTION

In response thereto, I have invented a particulate packaging system which comprises a vertical compression tower for shaping the particulate matter into a bulk-like form. The compression tower includes an internal ram which compresses the loose particulate material into a bulk form at the bottom of the tower. The bottom floor of the tower is presented by a conveyor belt, this conveyor belt with the formed material bulk thereon being vertically displaced from the tower proper. Upon separation of the material bulk from the tower, the underlying conveyor belt directs the bulk into a horizontally adjacent packaging system which includes vertically spaced apart upper and lower conveyor belt assemblies. The bulk is then compressed again between first portions of upper and lower conveyor assemblies so as to regulate the height of the material bulk while maintaining a fixed length and width thereof. Spanning the space between the upper and lower conveyor belt assemblies is a sheet of packaging material. The material bulk is conveyed through this packaging sheet so that the sheet envelops the bulk material for conveyance between second portions of upper and lower conveyor assemblies. When the bulk material is completely enveloped, the packaging sheet is severed and sealed. The use of the conveyor systems precludes the need to slide the material bulk and diminishes, if not precludes, the above discussed problems.

It is accordingly a general object of this invention to provide a novel, efficient particulate bulk forming and packaging system.

Another object of this invention is to provide a system, as aforesaid, utilizing a particulate compression tower and a reciprocative conveyor belt associated therewith.

A further object of this invention is to provide a system, as aforesaid, wherein the conveyor belt horizontally directs a shaped material bulk for downstream conveyance through a vertical sheet of packaging material.

A still further object of this invention is to provide a system, as aforesaid, wherein the sheet of packaging material spans upper and lower spaced conveyor systems which recompress and direct the bulk material through the packaging system.

Still another object of this invention is to provide a system, as aforesaid, which diminishes the separation of the particulate material from the material bulk mass.

A particular object of this invention is to provide a system, as aforesaid, which diminishes the production of fibrous lumps in the material bulk.

A further particular object of the invention is to provide a system, as aforesaid, wherein the height of the material bulk can be regulated to provide for packaging weight modifications without deviating from the length and width requirements necessary for palletization.

A still further object of this invention is to provide a system, as aforesaid, which presents the material bulk for packaging in a shrink wrap material.

Another particular object of this invention is to provide a system, as aforesaid, wherein a ram induced movement of the material bulk is precluded.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
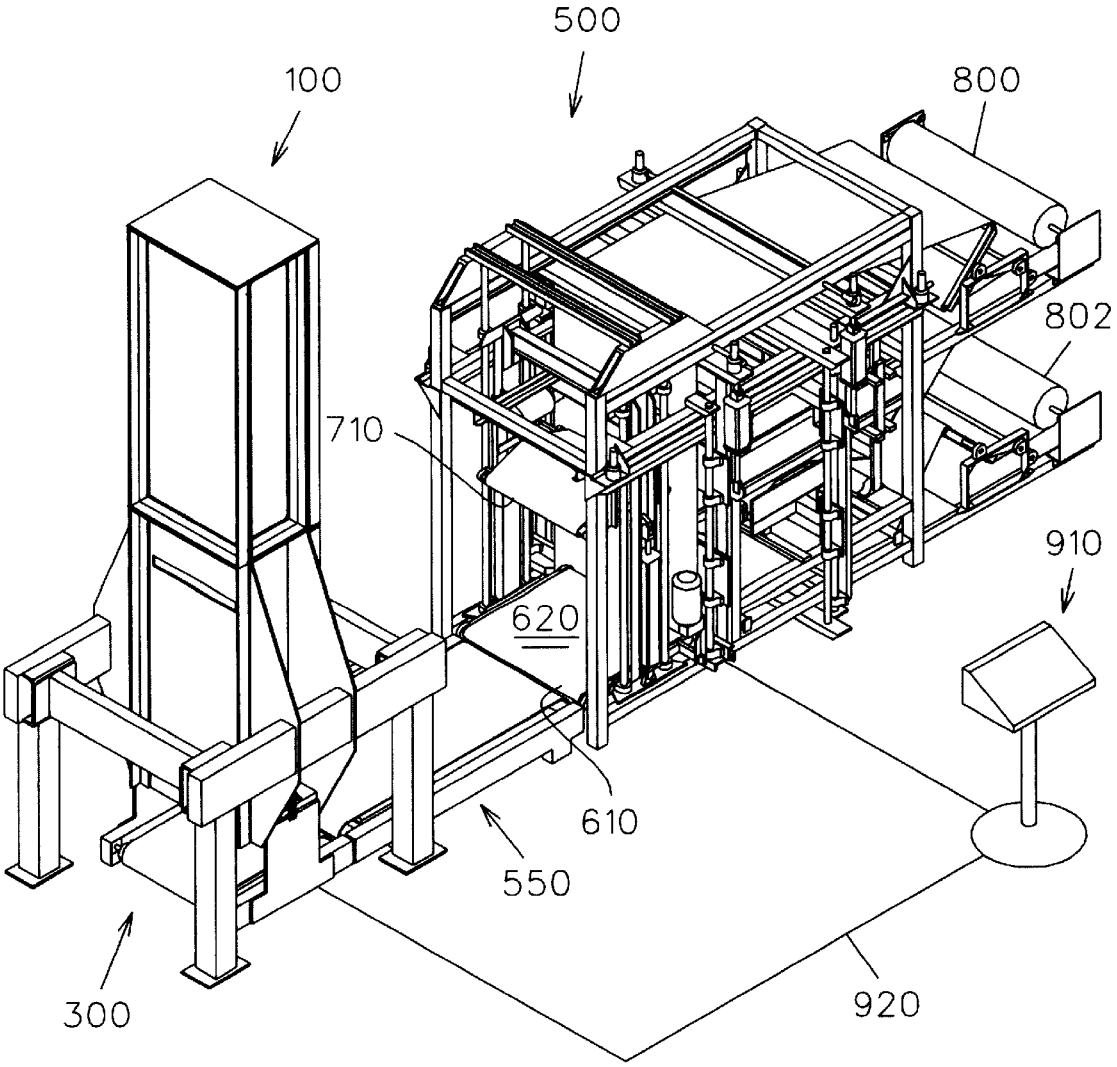
FIG. 1 is a perspective view of the system.
Figure 4:
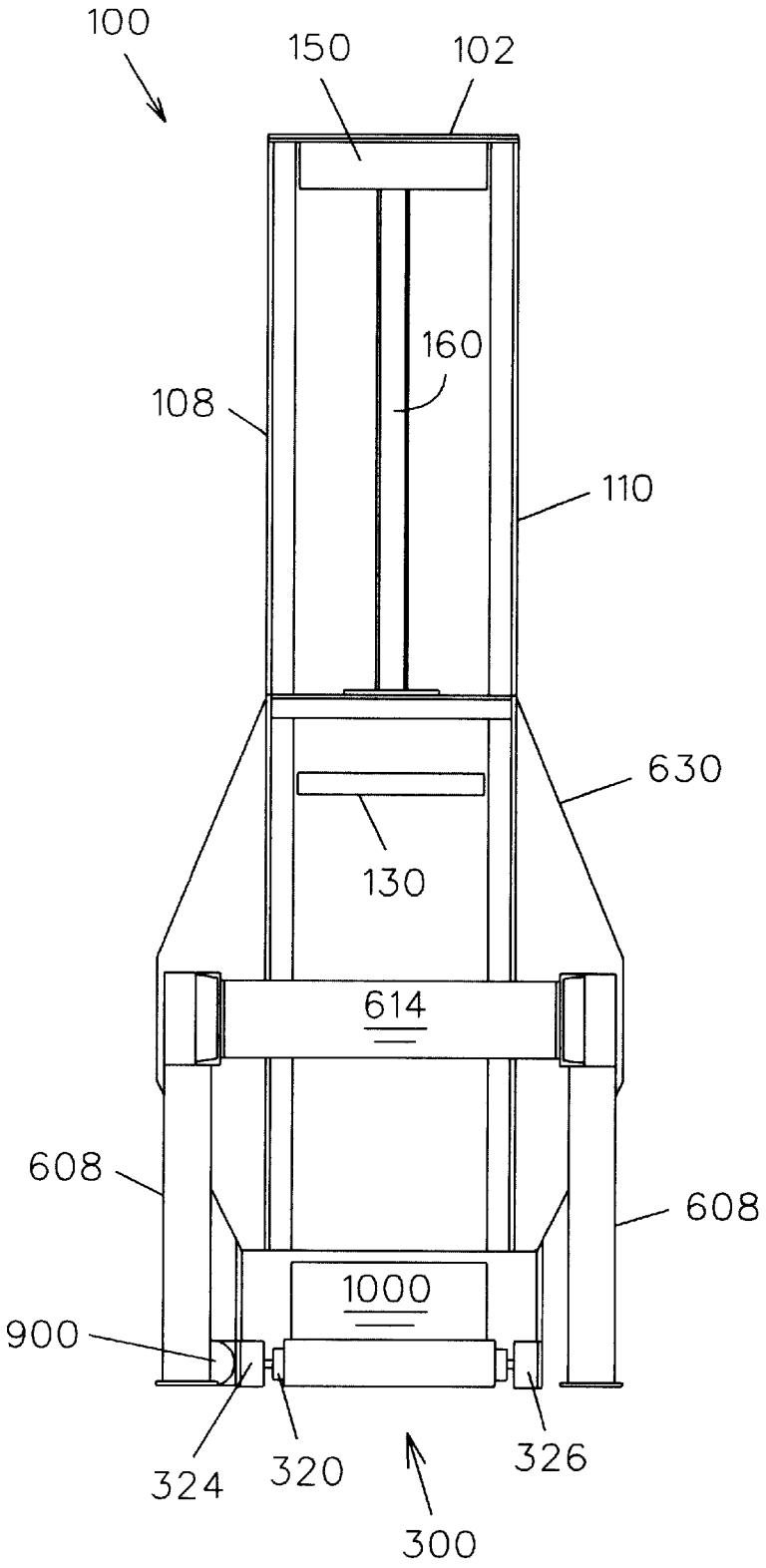
FIG. 4 is a left end view of the upstream end of the system of FIG. 2 in diagrammatic form.
Figure 5:
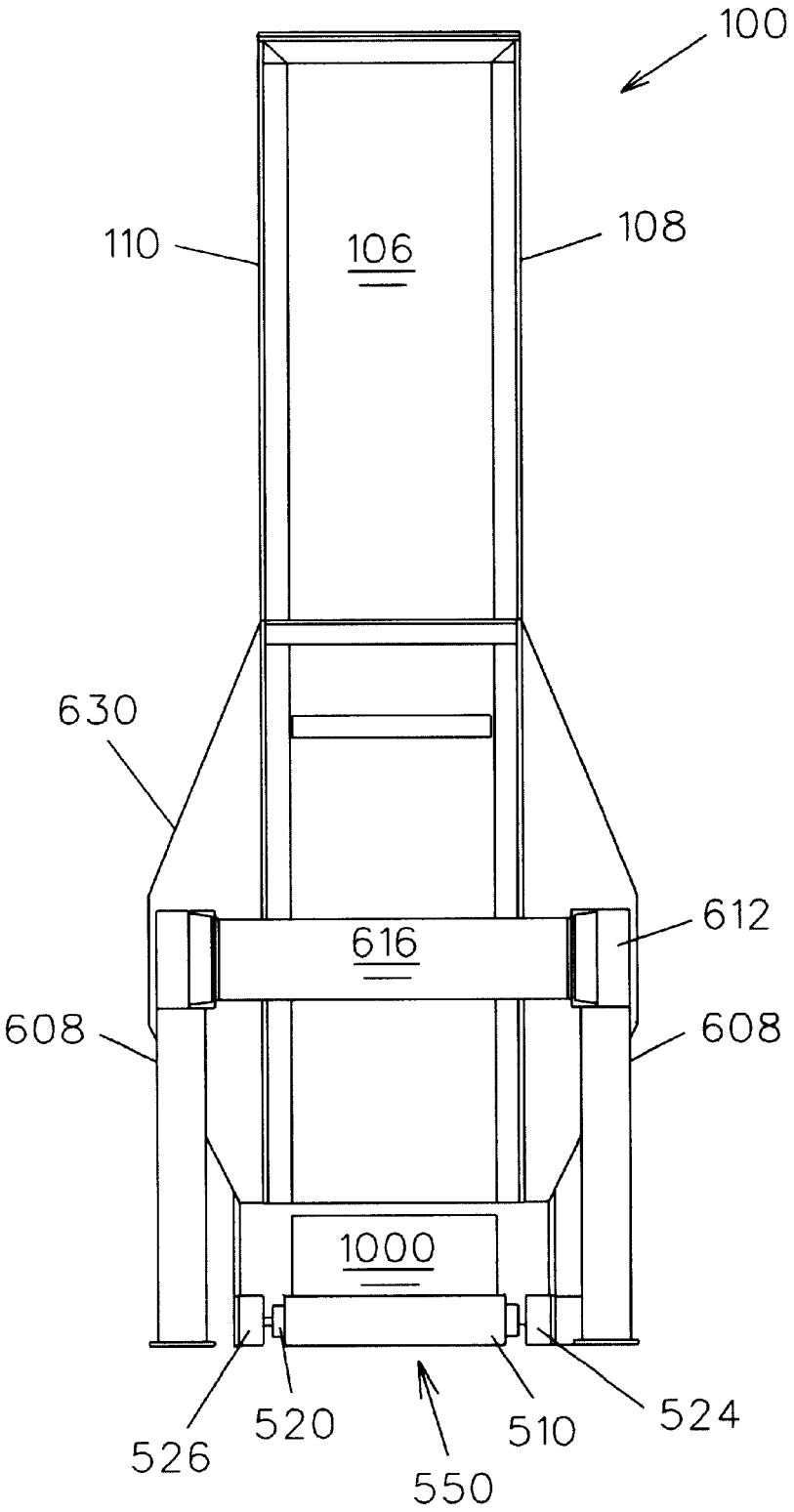
FIG. 5 is a right end view of the downstream end of the system of FIG. 3, in diagrammatic form.

Turning more particularly to the drawings, FIG. 1 shows the system as comprising a compression tower 100 for forming the loose particulate material into a bulk form 1000 and a downstream packaging station 500 for compressing and wrapping the resulting material bulk 1000 (FIG. 4) in plastic wrap 800*a*, 802*a* or the like.

Figure 6:
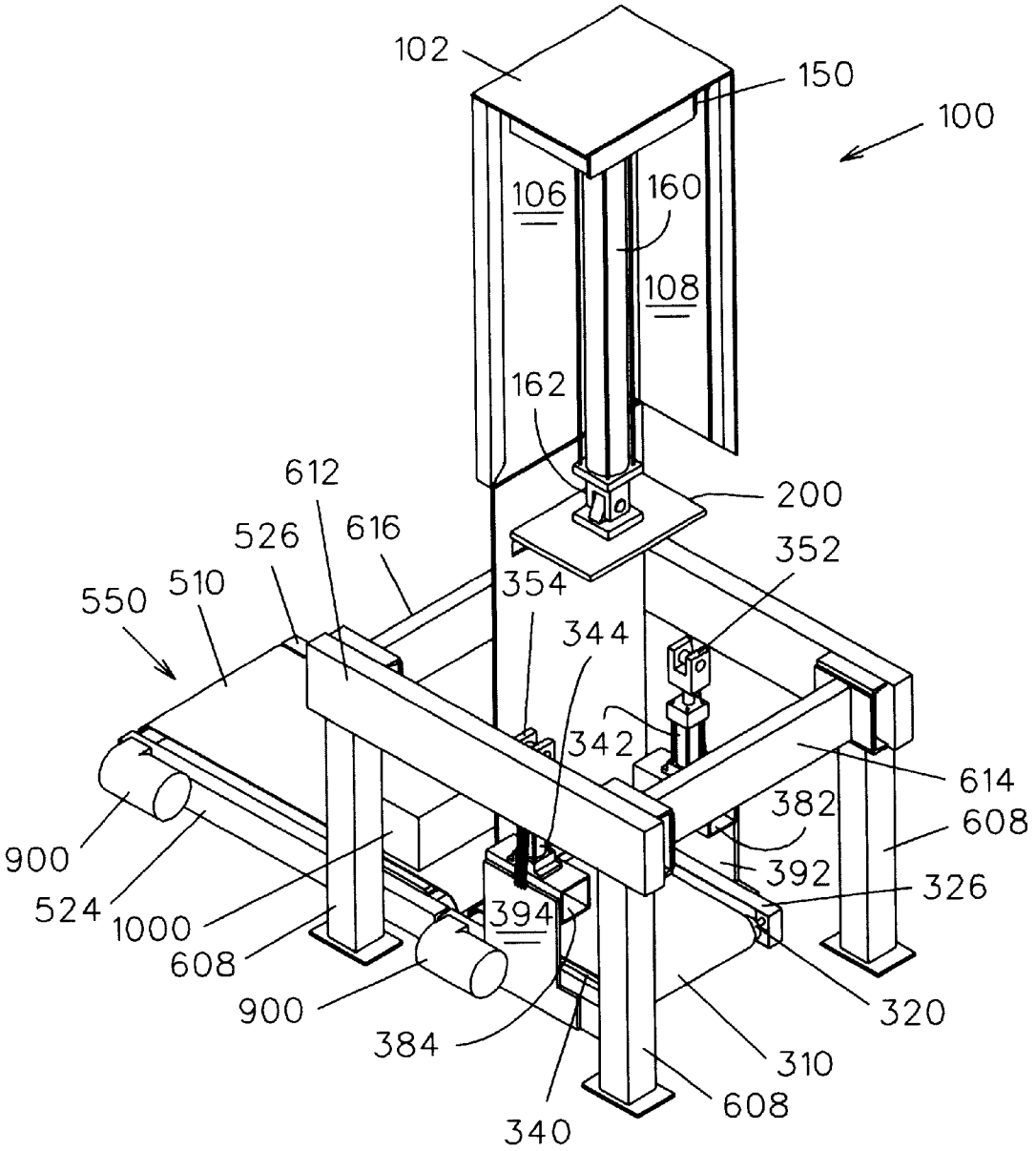
FIG. 6 is an opposed perspective view of the system of FIG. 2 with a portion of the side walls and one end wall of the compression tower being removed so as to show the interior thereof.
Figure 7:
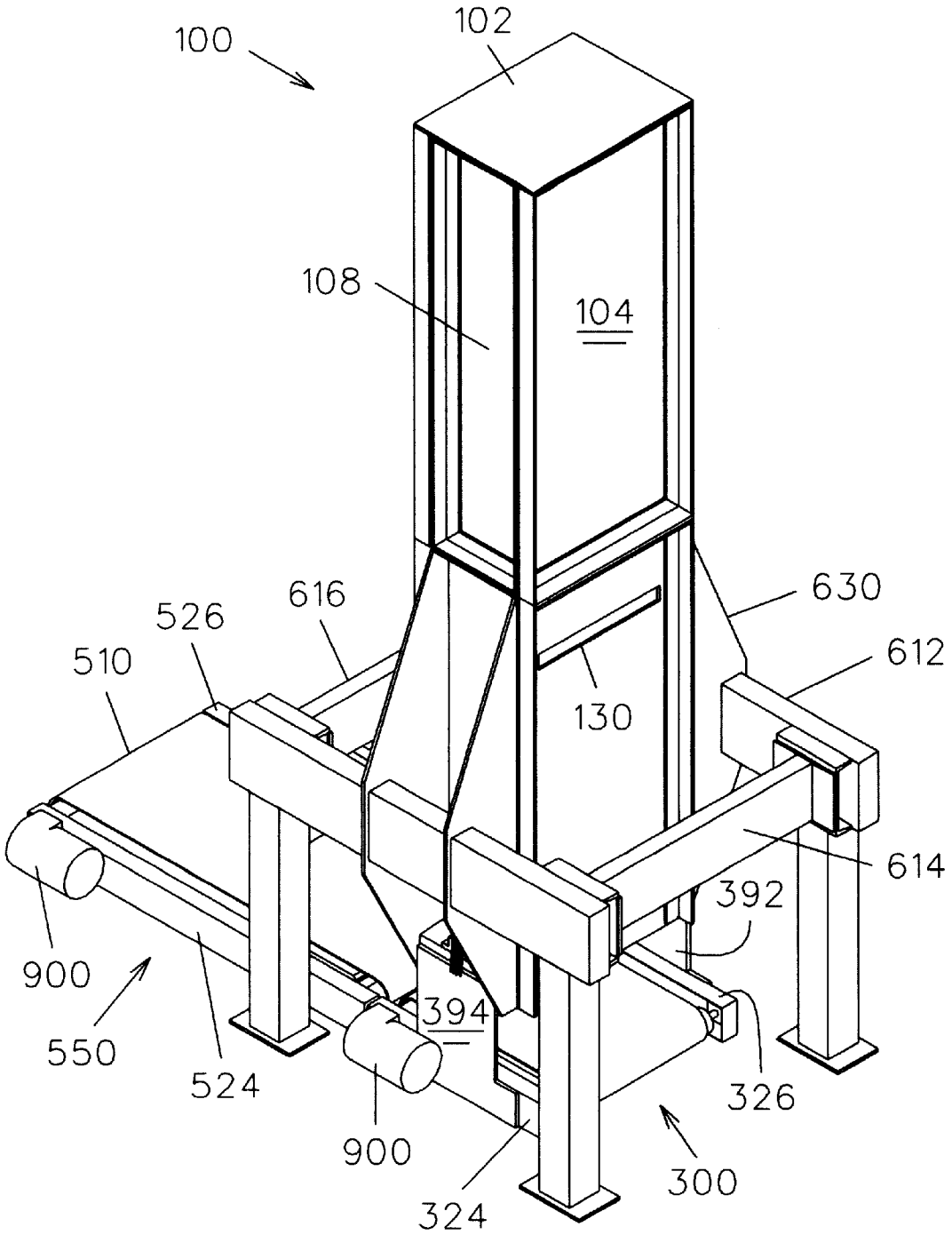
FIG. 7 is an opposed perspective view of the system of FIG. 6 with the walls of the compression tower in place.
Figure 10:
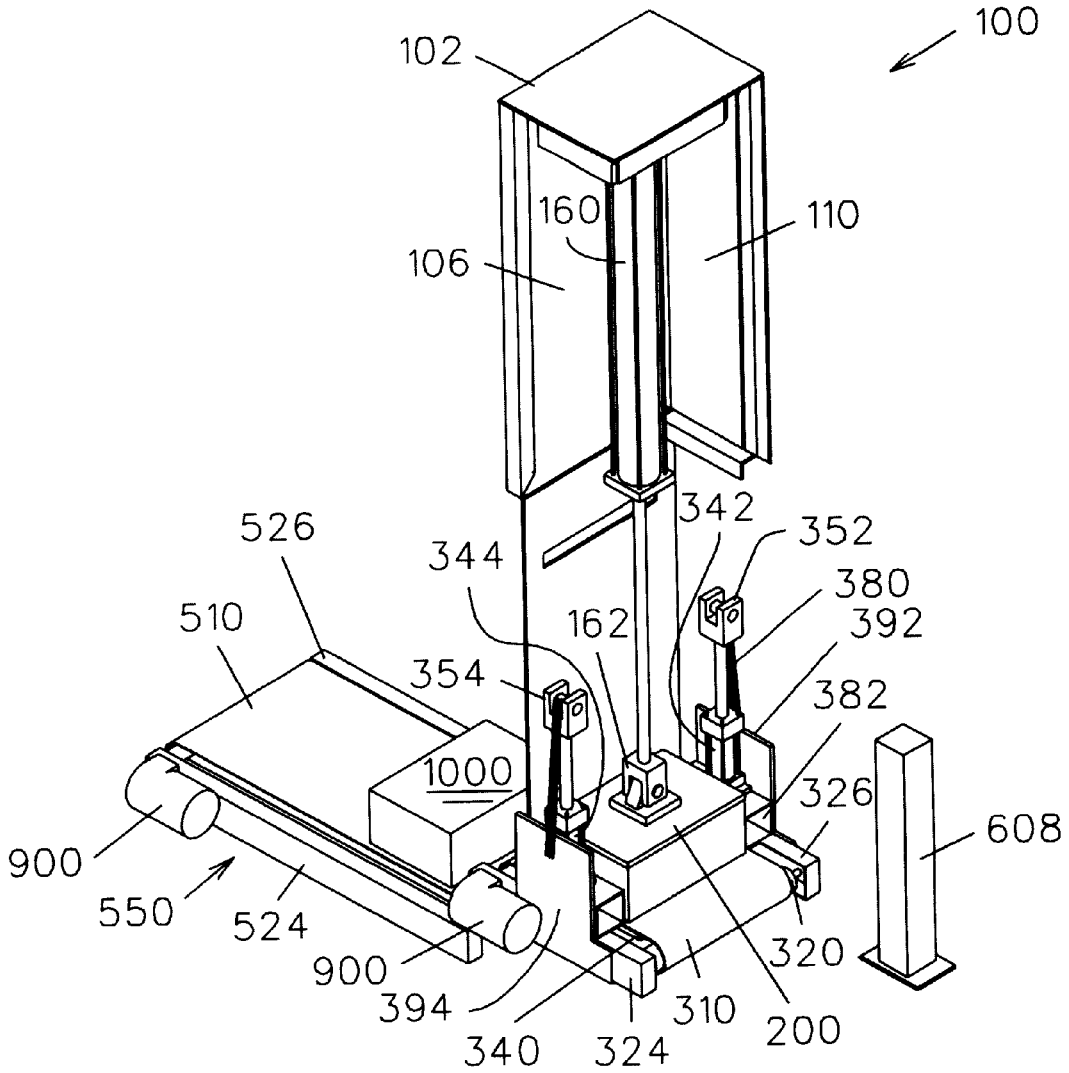
FIG. 10 is a perspective view of the system of FIG. 8 showing the compression ram in its functional position and a plurality of material bulks being conveyed by the system.
Figure 11:
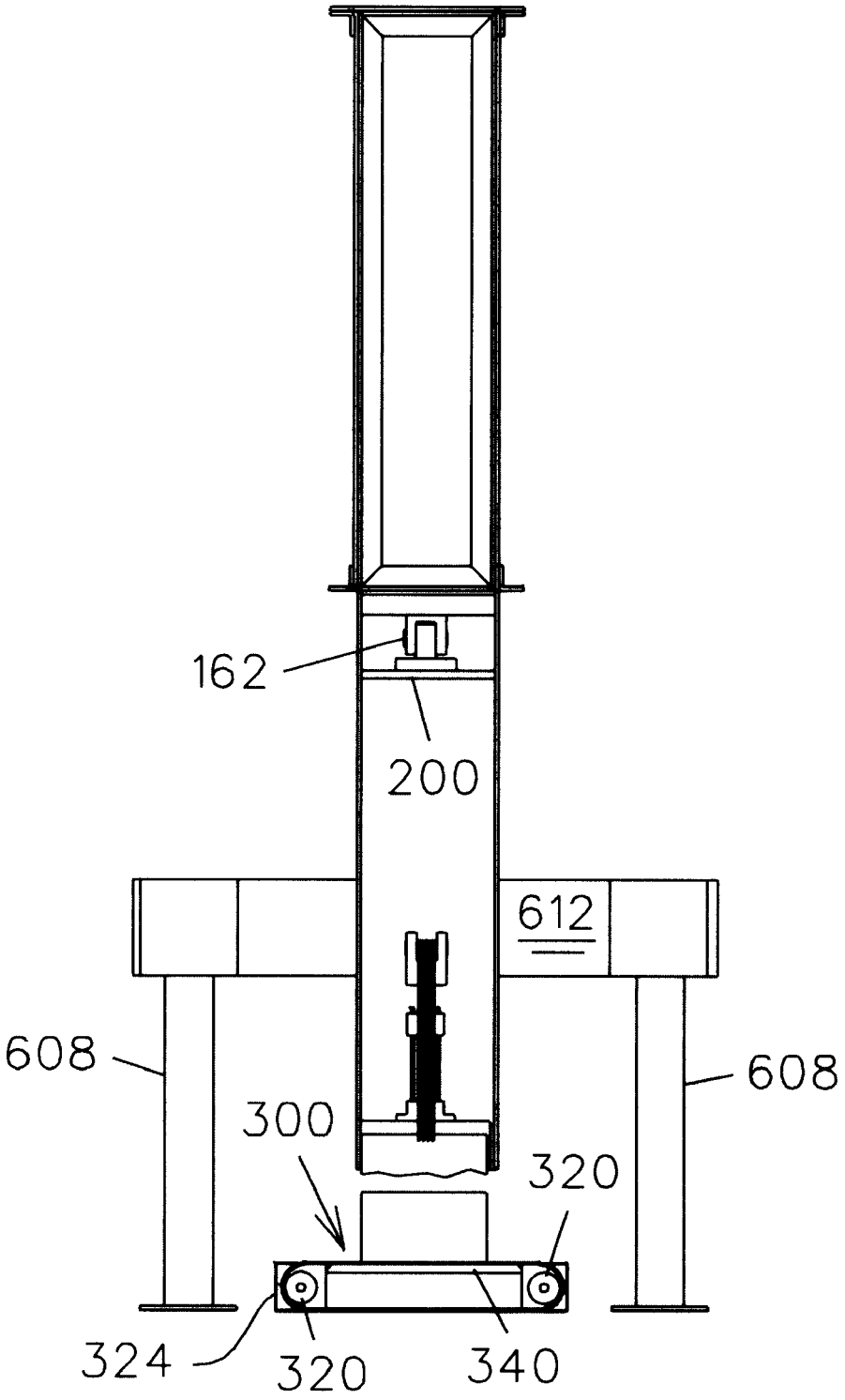
FIG. 11 is a side view of a system of FIG. 3 with a portion of the support framework, conveyor mounting flanges and conveyor side wall removed.

The compression 100 tower comprises a top wall 102, vertical side walls 104, 106 and end walls 108, 110. Within the tower 100 is a mounting plate 150 adjacent the top wall 102 with a piston/cylinder combination 160 depending therefrom (FIG. 6). At the free bracketed end of the reciprocating piston rod 162 is attached a compression plate 200, the plate having a configuration generally congruent to the lower open end 120 of the tower 100. As shown, the piston rod 162 is reciprocatively extendable between a position in which the plate 200 is above the material inlet 130 (FIG. 4) and a second functional position adjacent the open bottom 120 of the tower (FIG. 10).

The tower 100 is supported by a framework which comprises a plurality of vertical legs 608 with side cross struts 610, 612 and end struts 614, 616 extending therebetween and through support flanges 620, 630 extending from the sidewalls 108, 110 of the tower 100.

Figure 8:
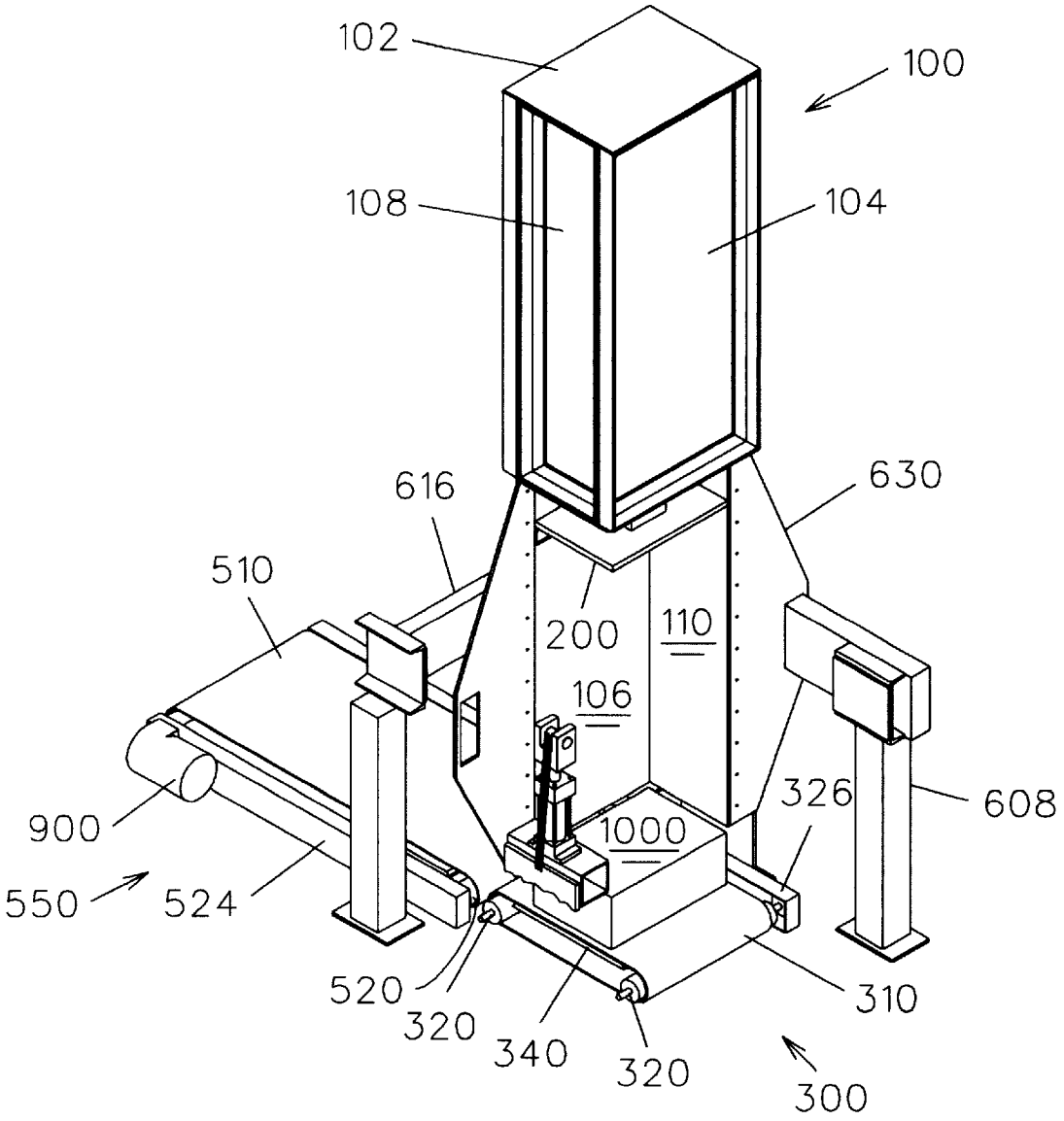
FIG. 8 is a view of the system of FIG. 7 with a portion of the support frame of the compression tower removed and showing a material bulk on the conveyor assembly underlying the compression tower.

Located below the bottom aperture 120 of the tower 100 is a first conveyor belt assembly 300 including a conveyor belt 310 mounted about rollers 320 extending between rails 324, 326. A support plate 340 (FIG. 8) underlies the top surface of the conveyor belt 310. Plate 340 is configured to approximate the lower open end 120 of the tower 100.

Figure 9:
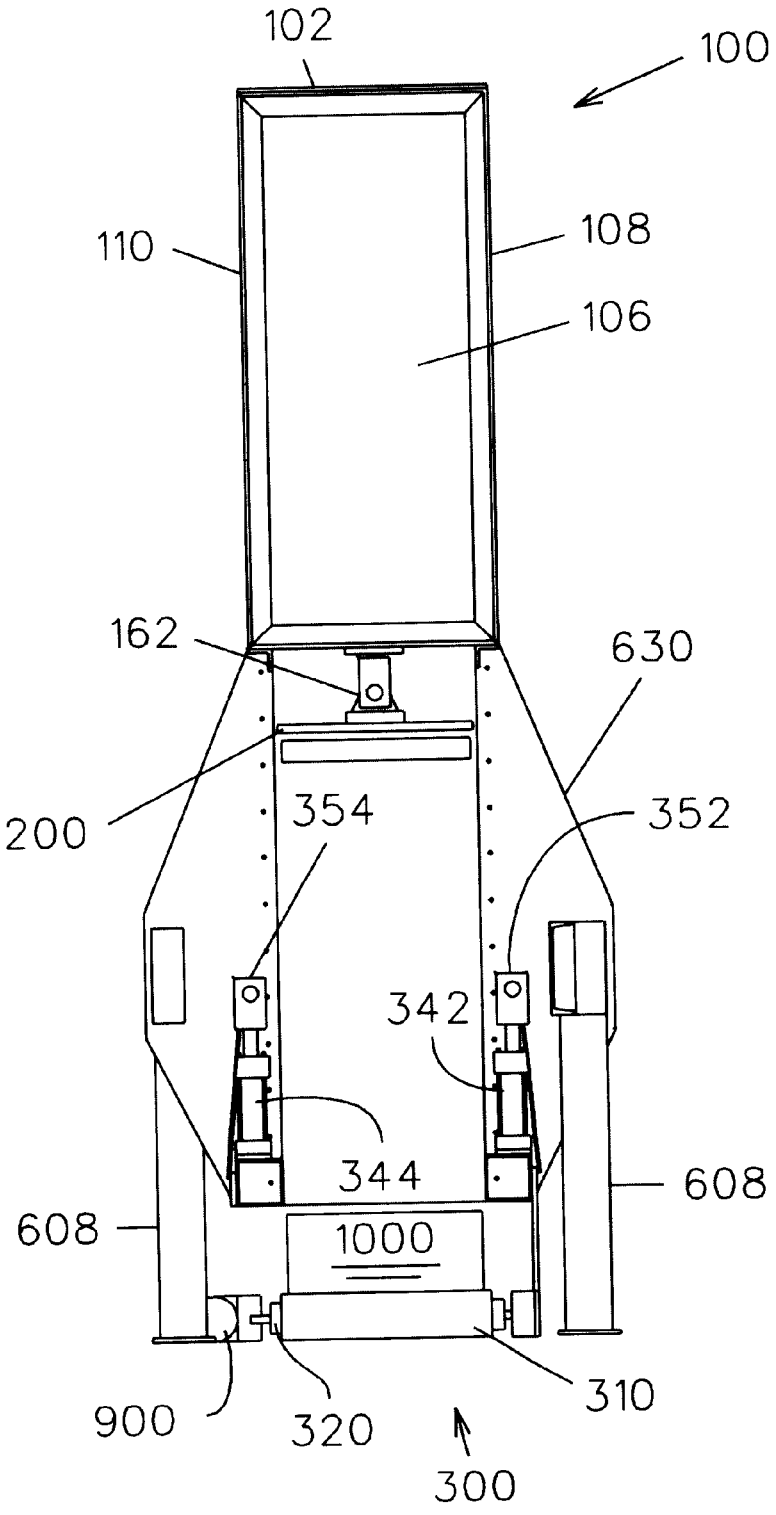
FIG. 9 is an end view of the system, as in FIG. 4, with a portion of the support frame and cylinder mounting flanges of the tower removed.

The first conveyor system 300 is movable between a first position in which the conveyor belt 310 and underlying plate 340 closes the bottom aperture 120 of the tower 100 and a second position vertically displaced from the tower. This movement is provided by first and second piston/cylinder combinations 342, 344 attached to brackets 352 and 354 which are connected to the flange walls 620, 630 of the tower (FIG. 9).

Attached to the lower end of each respective cylinder is a mounting flange 382, 384 to which depending mounting plates 392, 394 are attached (FIG. 10). These plates 392, 394 are attached to the rails 324, 326 of the conveyor assembly 300. Roller chains 380 extending between the respective brackets 352, 354 and plates 392, 394 provide further support. Accordingly, the conveyor system 300 can be reciprocated by operation at the piston/cylinder combinations 342, 344 between a first position in which the top surface of the conveyor belt 310 with plate 340 therein closes the tower aperture 120 and a second lower position displaced from the tower 100 as shown in the drawings.

Downstream from the tower 100 is the packaging station 500 which includes a conveyor belt assembly 550 horizontally adjacent the conveyor belt assembly 300 when the conveyor belt is at its second vertically displaced position relative to the tower 100 (FIG. 6). The conveyor system 550 includes a belt 510 mounted about rollers 520 extending between first and second laterally spaced apart rails 524, 526. The operation of the tower 100 is also as described in my pending application as above identified.

Figure 12:
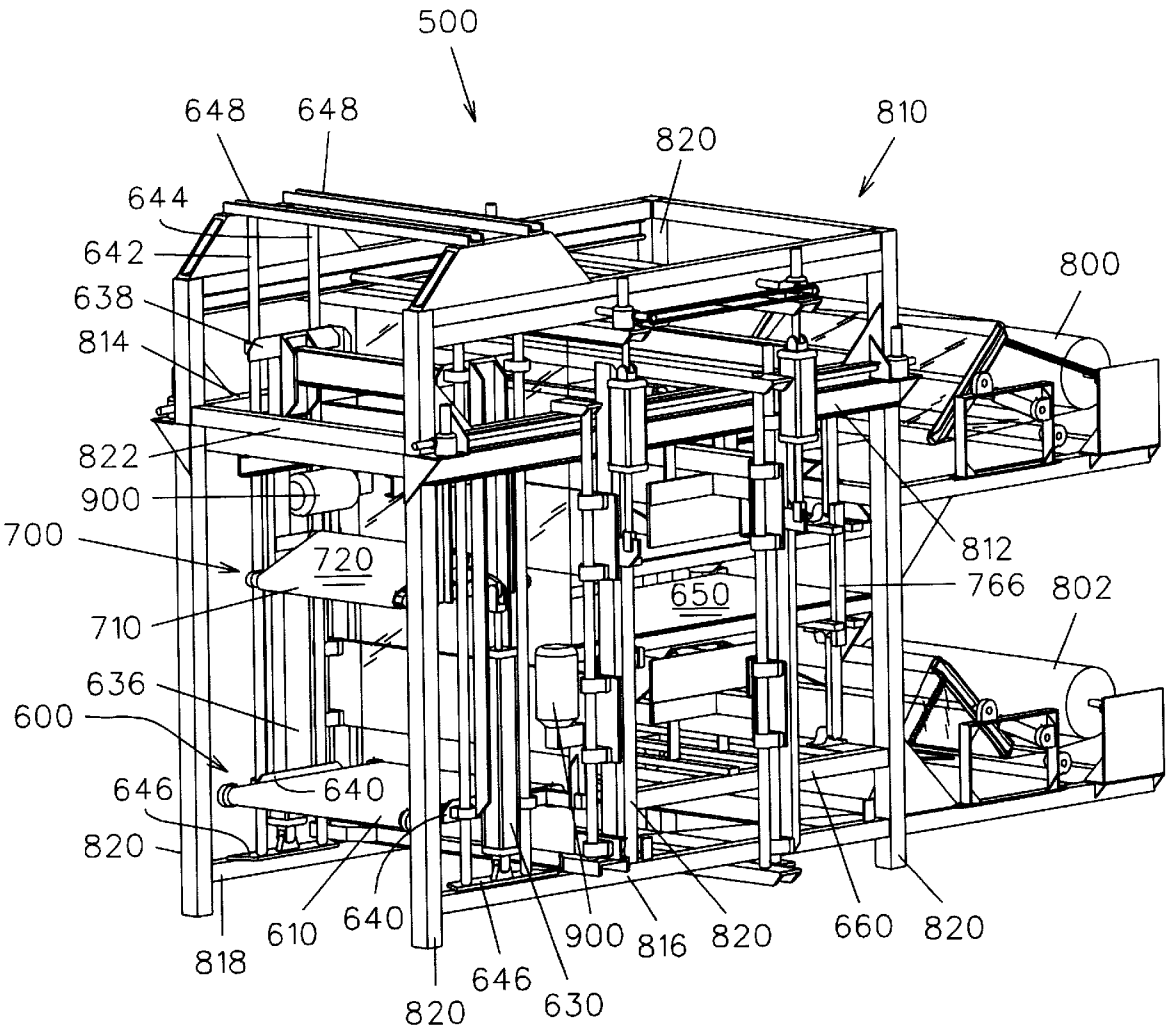
FIG. 12 is a perspective view of the downstream packaging station of the system.

As shown in FIG. 12, the packaging system 500 is supported by a framework 810 having laterally spaced apart upper 812, 814 and lower rails 816, 818 with vertical legs 820 extending therebetween. Cross struts 822 extend between legs 820 for further support.

Figure 14:
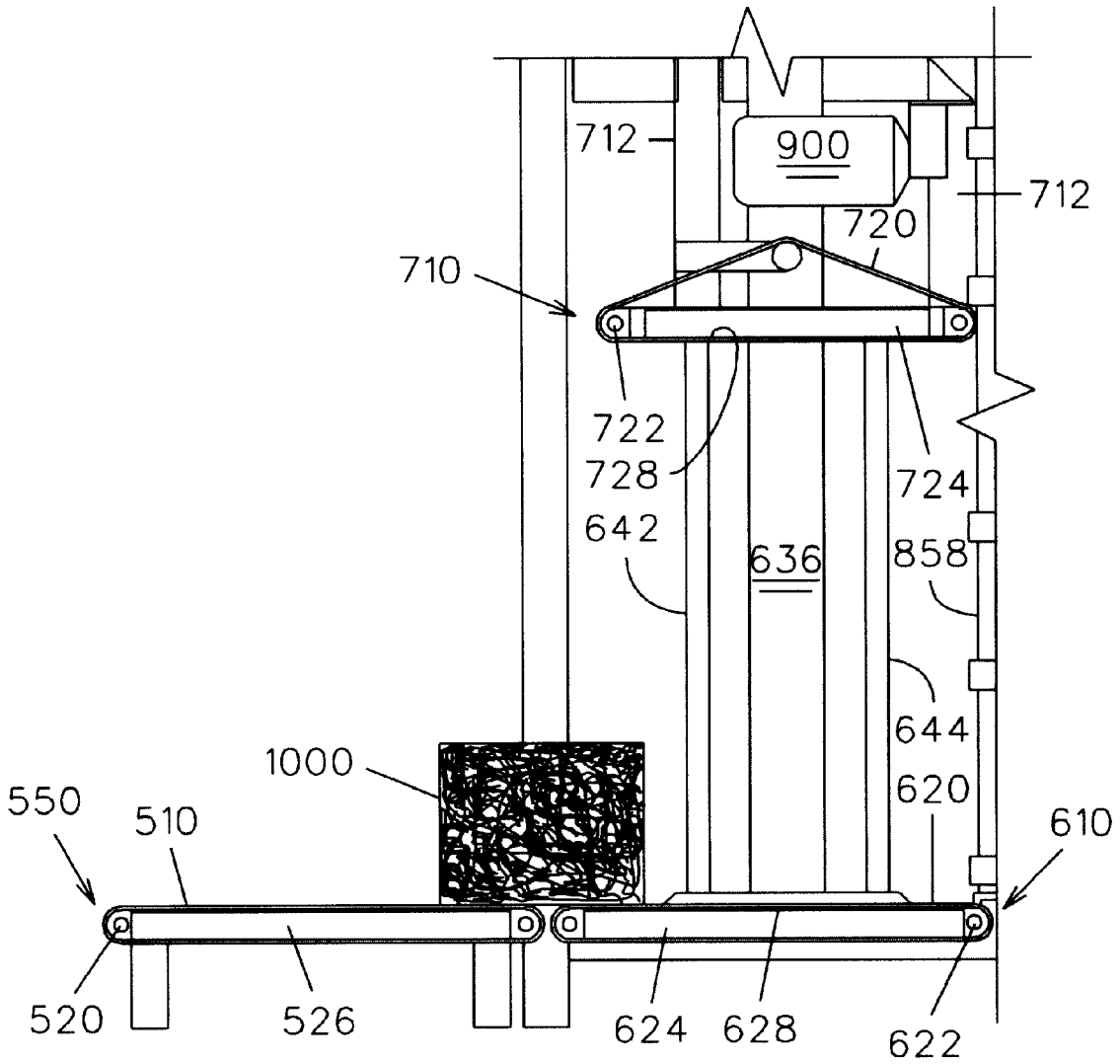
FIG. 14 is a fragmentary view of the system of FIG. 13 with some portions of the framework, support beams, and piston/cylinder combinations removed to shown first portion of the lower conveyor assembly in a first position.
Figure 15:
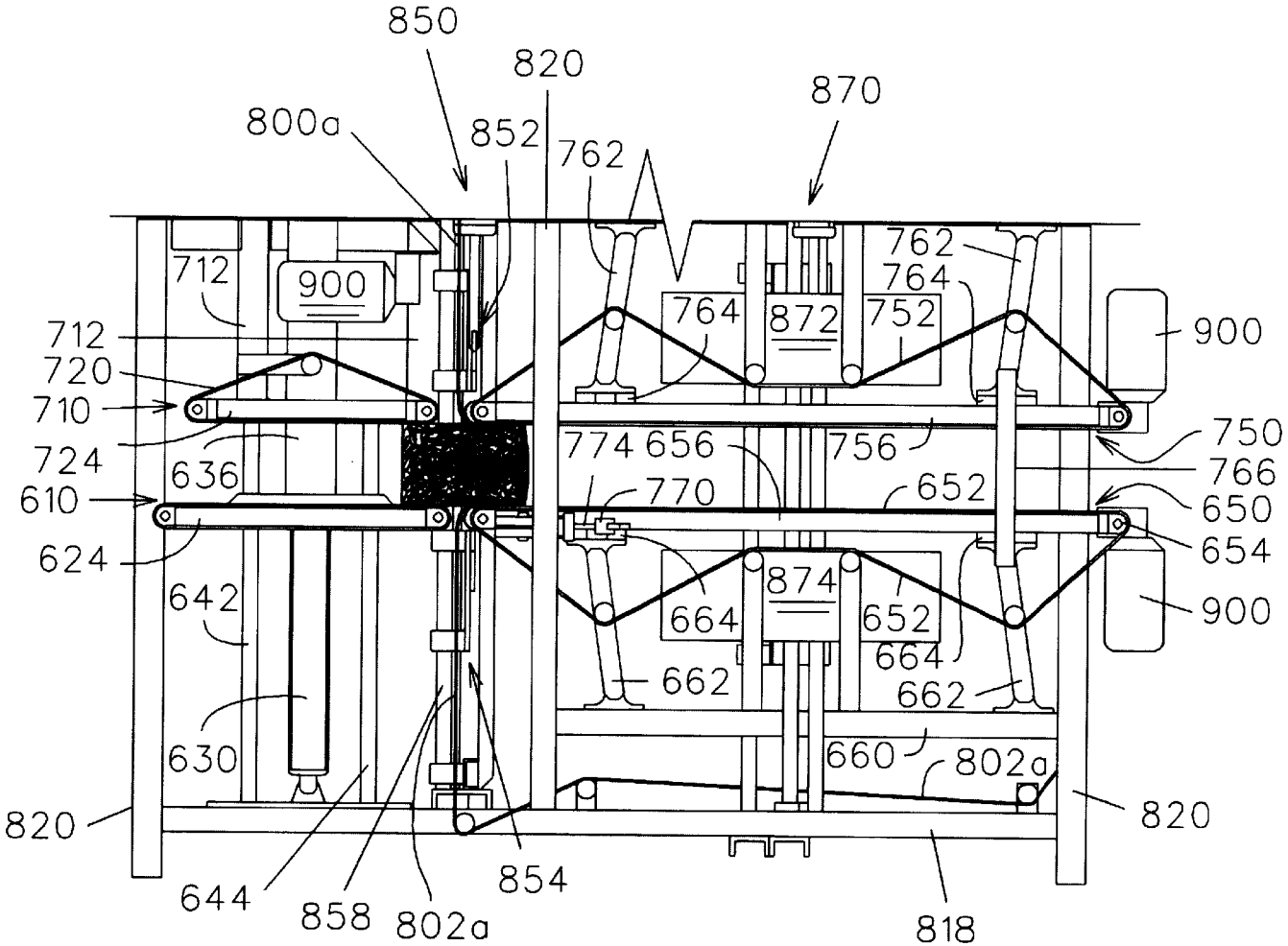
FIG. 15 is side view of the system of FIG. 12 with some portions of one side of the framework, support beams, and piston/cylinder combinations removed to show a first portion of the lower conveyor assembly in a second raised position.
Figure 16:
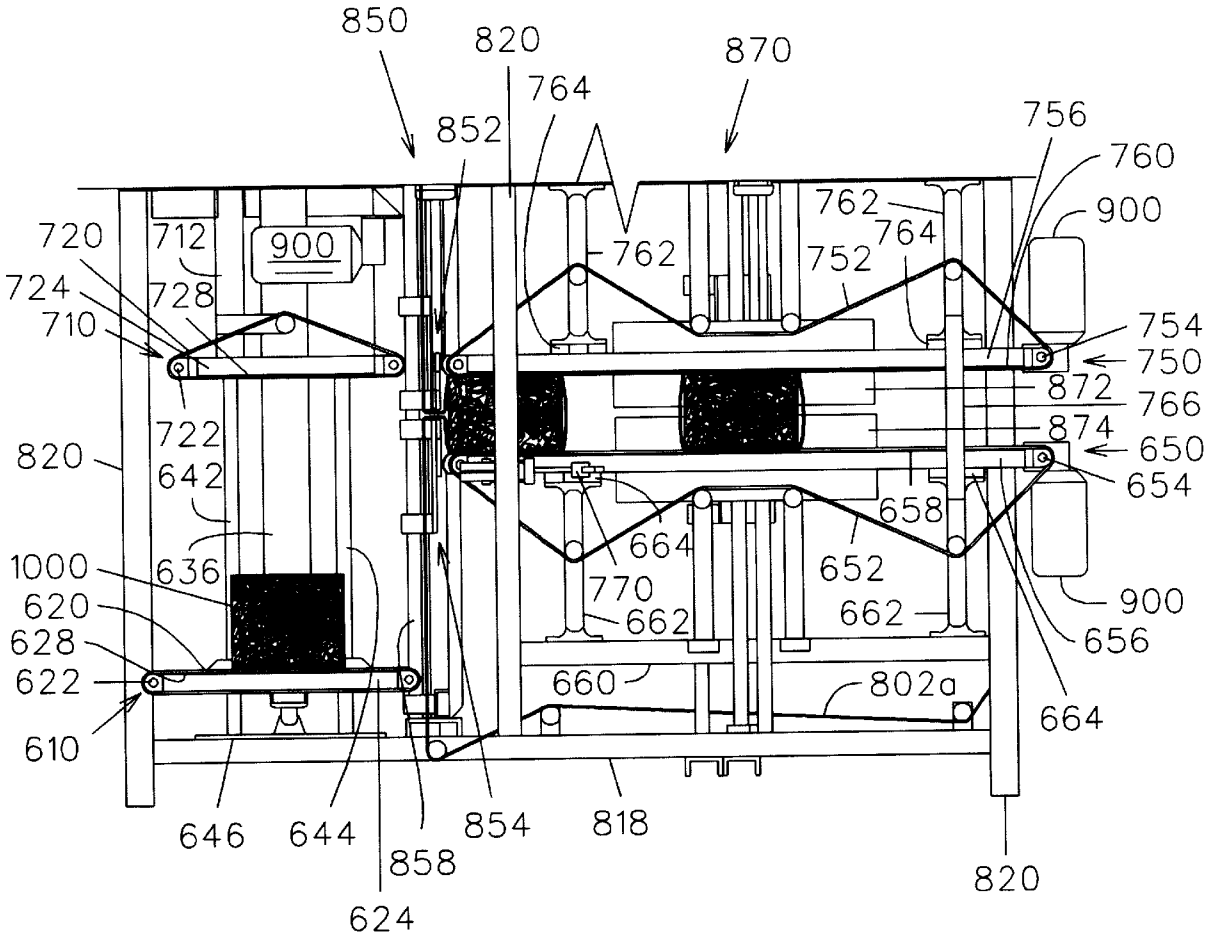
FIG. 16 is a view of the system of FIG. 15 showing a first portion of the lower conveyor between a first and second position.
Figure 17:
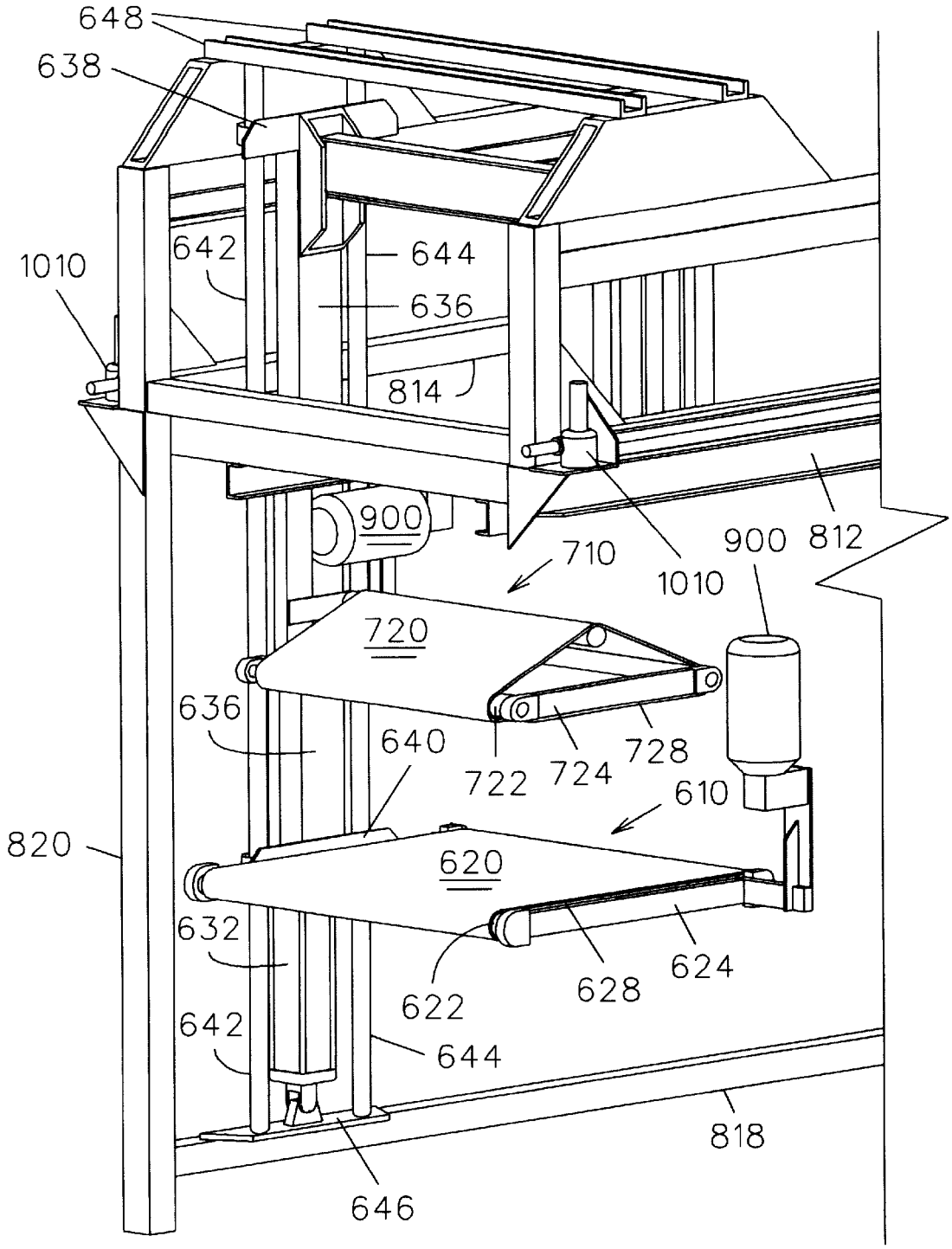
FIG. 17 is a fragmentary perspective view of the system of FIG. 12 with portions of the framework, support beams, and piston/cylinder combinations removed to show first portions of the conveyor assemblies.

The packaging system 500 includes lower 600 and upper 700 conveyor assemblies, each assembly having first 610, 710 and second portions 650, 750 respectively (FIGS. 15 and 16). The first portion 610 of the lower conveyor assembly 600 includes a conveyor belt 620 mounted about rollers 622 extending between rails 624, 626 (FIG. 17). A supporting plate 628 underlies the top surface of the conveyor belt 620. The first portion 610 of the lower conveyor assembly 600 is movable between a first position in which the conveyor belt 620 is horizontally adjacent conveyor belt 510 upstream of conveyor assembly 550 (FIG. 14) and a second raised position horizontally adjacent second portion 650 of the lower conveyor assembly 600 (FIG. 15). This movement is provided by first and second piston/cylinder combinations 630, 632 (FIGS. 13 and 17) as described below.

Figure 13:
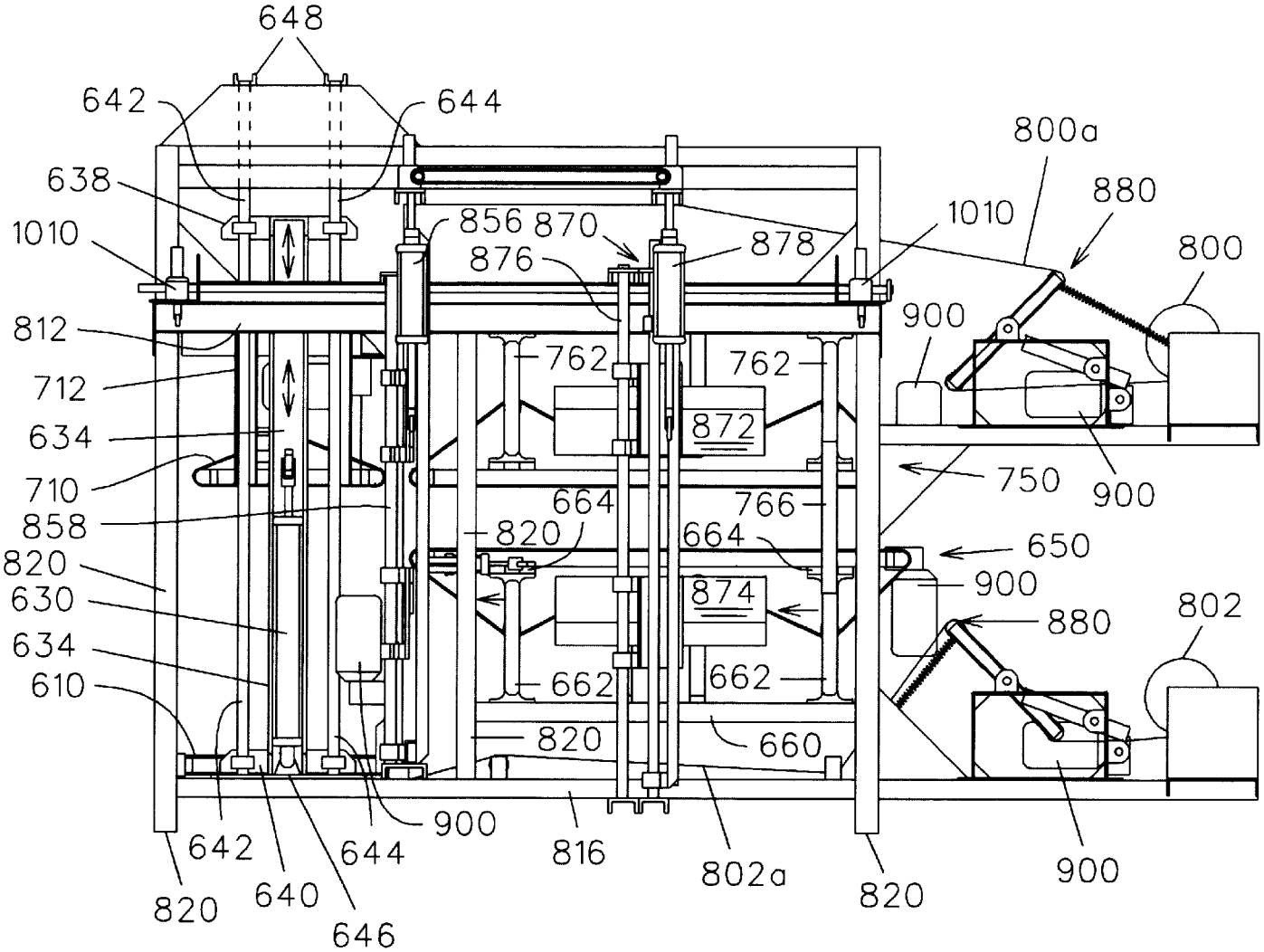
FIG. 13 is a side view of the system of FIG. 12.

The piston rod of each piston/cylinder combination 630, 632 is attached to a vertically movable support beam 634, 636, each support beam having upper 638 and lower plates 640 attached thereto (FIGS. 13 and 17). Each plate 638, 640 is slidably coupled to laterally spaced apart guide bars 642, 644, lower and upper ends of the guide bars being fixedly attached to mounting plates 646 on lower rails 816, 818 and to upper beams 648, respectively.

Figure 2:
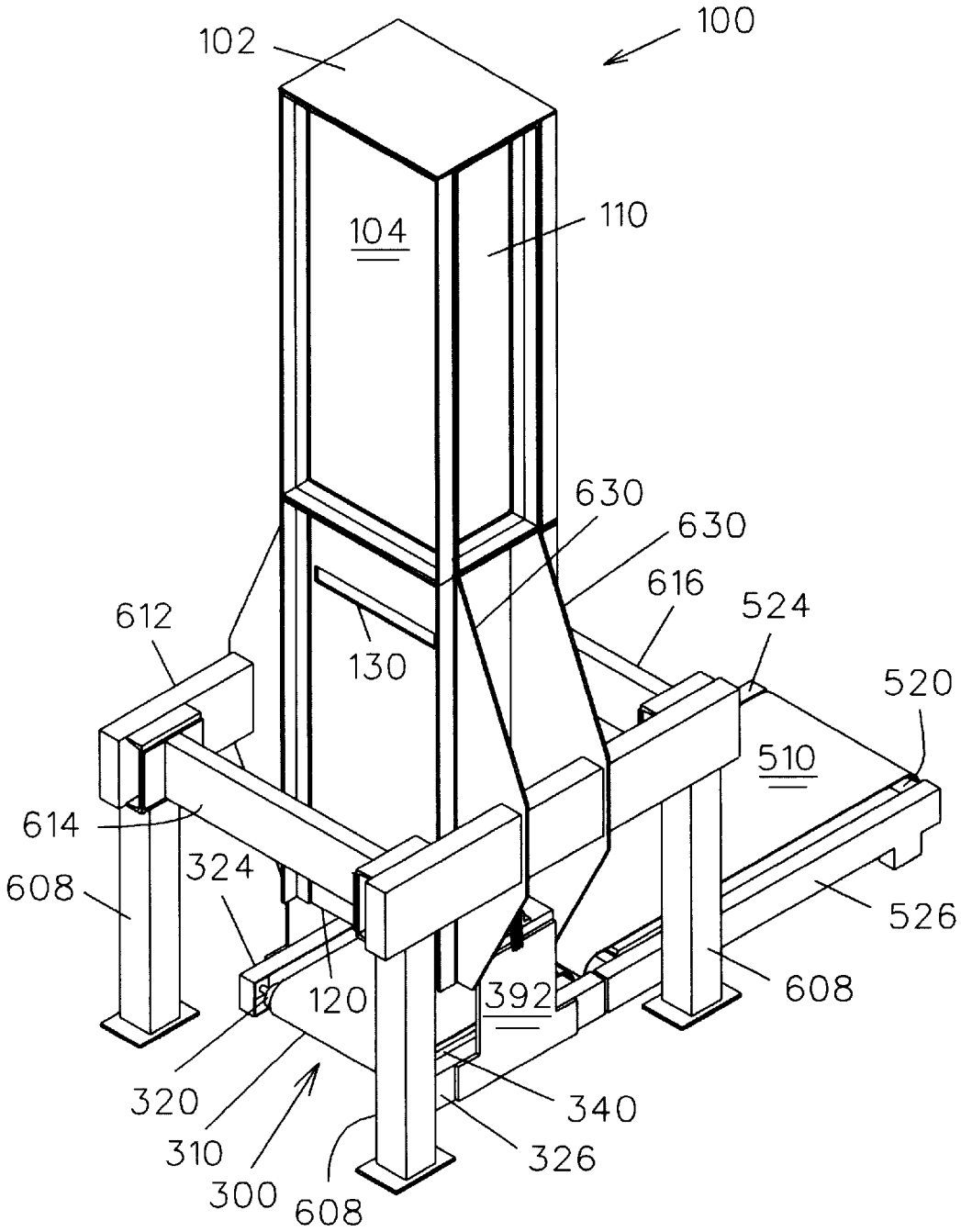
FIG. 2 is a perspective view of the compression tower of the system.
Figure 3:
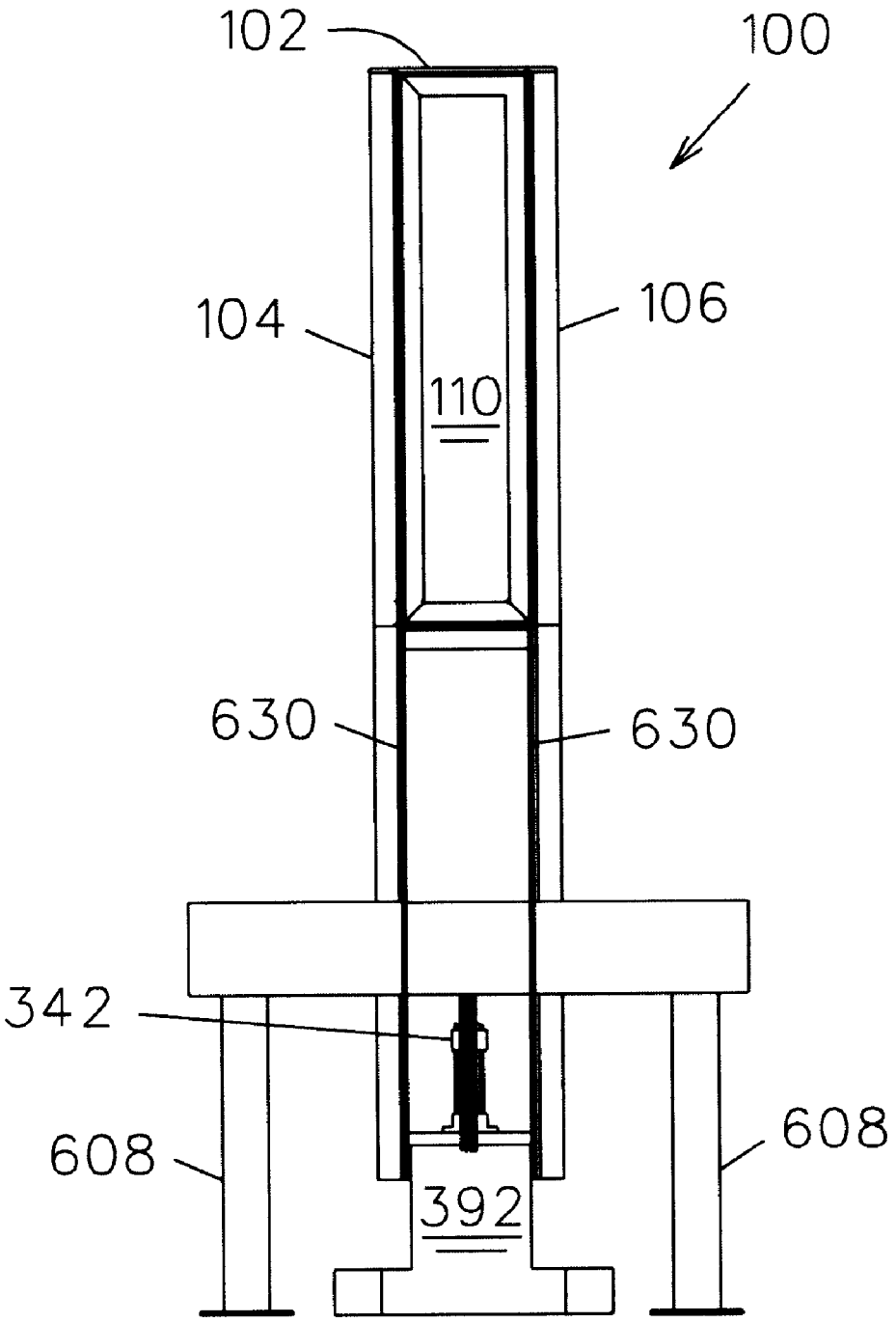
FIG. 3 is a side elevation view of the system of FIG. 2 in diagrammatic form.

Each lower plate 640 is further fixedly attached to rails 624, 626 of the first portion 610 of the lower conveyor assembly 600 (FIG. 2). Accordingly, the first portion 610 of the lower conveyor assembly 600 can be reciprocated by operating the piston/cylinder combinations 630, 632 between a first position horizontally adjacent the upstream conveyor belt assembly 550 at which the lower plate 640 on each support beam 634, 636 is adjacent the base of the framework. Upon extension of the piston the beams 634, 636 will likewise move upward which moves plates 640 along guide bars 642, 644 and the lower conveyor assembly 600 attached thereto. Thus, assembly 600 is at a second raised position horizontally adjacent the second downstream portion 650 of the lower conveyor assembly 600 and spaced from the first portion 710 of the upper assembly at a selected distance.

The first portion 710 of the upper conveyor assembly 700 is attached to upper rails 812, 814 with bars 712 and includes a conveyor belt 720 mounted about rollers 720 extending between rails 724, 726 (FIG. 17). A supporting plate 728 underlies the bottom surface of the conveyor belt 720. Thus, a material bulk which has been conveyed to a position atop first portion 610 of lower conveyor assembly 600 is again compressed between first portions 610, 710 of lower 600 and upper 700 conveyor assemblies.

As best shown in FIG. 16, the second downstream portion 650 of the lower conveyor assembly 600 includes a conveyor belt 652 mounted about rollers 654 extending between rails 656. A supporting plate 658 underlies the upper surface of the conveyor belt 652. The second portion 650 of the lower assembly 600 is pivotally attached to a lower cross-strut 660 with first and second pairs of spaced apart lower rocker arms 662. A mounting plate 664 is sandwiched between each lower rocker arm 662 and rail 656 of the second portion 650 of the lower assembly 600.

Similarly, the second downstream portion 750 of the upper conveyor assembly 700 includes a conveyor belt 752 mounted about rollers 754 extending between rails 756. A supporting plate 760 underlies the bottom side of the conveyor belt 752. The second portion 750 of the upper assembly 700 is attached to upper rails 812, 814 of the framework 810 with upper rocker arms 762. A mounting plate 769 is sandwiched between each upper rocker arm 762 and rail 756 of the second portion. At least one pair of upper 762 and lower 662 rocker arms (right side as viewed in FIG. 15) are fixedly joined together with braces 766. As shown in FIG. 15, when a material bulk 1000 has been recompressed between first portions 610, 710 of the lower 600 and upper 700 conveyor assemblies, the rocker arms 662, 762 are simultaneously pivoted to shift second portions 650, 750 between a first position laterally spaced from first portions 610, 710 and a second position immediately adjacent first portions. This pivotal movement is provided by piston/cylinder combinations 770 with the cylinder 772 in a fixed position. One end of rod 774 is attached to the mounting plates 664 of at least one pair of opposed lower 662 rocker arms opposing ends of piston/cylinder combinations 770 being mounted to opposed central legs 812 of the framework 810. This extension of piston rod 774 will pivot the lower rocker arms 662 about their pivot points. As braces 766 link the upper rocker arms 762 to lower rocker arms 662 this motion is transferred to upper portion 750 to likewise vary the gap between the upper first and second conveyor portions. Likewise retraction of piston rods 774 into cylinder 772 reverses the rocker arm movement so as to narrow the gap between the longitudinally adjacent portion of the conveyor assemblies. This action diminishes the decompression of the bulk as it passes across the gap.

Accordingly, the gap between first portions 610, 710 and second portions 650, 750 of lower 600 and upper 700 conveyor assemblies is regulated to prevent loss of material bulk fibers as the bulk is conveyed between first and second portions (FIG. 15). The upper conveyor assembly 700 is spaced from the lower assembly 600 such that the respective belts 652, 752 of the second portions 650, 750 contact the bottom and top surfaces of the bulk 1000 once positioned therebetween. It is understood that the spaced relationship between upper 700 and lower 600 conveyor assemblies may be manually adjustable. For example, conveyor assembly 600 may be displaced by user movement of the support beams 634, 636 along the guide bars 642, 644 and maintenance thereat such as by bolts extending through apertures in the guide bars precluding movement of the lower plates 640. Assembly 650 may be mounted in different vertical positions or the framework according to the desired distance between the upper 752 and lower 652 belts. This vertical adjustment allows the height of the material bulk 1000 to be user adjusted prior to packaging thereof. When a material bulk has been conveyed to a position between second portions 650, 750, the rocker arms 662, 762 are simultaneously pivoted in an opposed direction by operation of piston/cylinder 770 to shift second portions to the first position in the manner previously described (FIG. 16). This action also aids in envelopment of the packaging material about the bulk as to be described.

The packaging station frame 810 supports a pair of bolts of packaging material 800, 802 presenting sheets 800*a*, 802*a* of packaging material which pass through longitudinal space between the adjacent conveyors so as to span the space between second portions 650, 750 of lower 600 and upper 700 conveyor belt assemblies. The packaging station 500 includes a cutter/sealer 850 of a type known in the art having upper 852 and lower 854 portions for first thermally sealing the packaging sheets 800*a*, 802*a* into a single sheet which spans the distance between upper and lower conveyor belt assemblies (FIGS. 15 and 16).

Piston/cylinder combinations 856 are utilized to move upper 852 and lower 854 portions of the cutter/sealer 850 from a first spaced apart position which allows a material bulk 1000 to pass through second portions 650, 750 of lower 600 and upper 700 conveyor belt assemblies and spanning material sheets (FIG. 15) to a second position wherein upper 852 and lower 854 portions of the cutter/sealer close behind the bulk (FIG. 16). Upon closing, the cutter/sealer 850 cuts the package material and thermally seals the cut ends thereof. Upper 852 and lower 854 portions of the cutter/sealer 850 are coupled together and slidably mounted to a guide bar 858 so as to simultaneously move in opposed directions.

Downstream from the cutter/sealer 850 is another sealer 870 of a type known in the art having a pair of upper sealing plates 872 oppositely disposed about rails 756 of the second portion 750 of upper conveyor belt assembly 700 and a pair of lower sealing plates 874 oppositely disposed about rails 656 of the second portion 650 of lower conveyor assembly 600 (FIG. 2). Upper 872 and lower 874 sealing plates are coupled together and slidably mounted to guide bars 876 so as to move in opposed directions. Piston/cylinder combinations 878 (FIG. 13) are utilized to move the sealing plates between a first open position and a second position in which lower sealing plates 874 contact upper sealing plates 872 thus to seal the packaging material sandwiched therebetween (FIG. 16).

It is understood that the various conveyor belt assemblies 300, 550, 600, 700 are powered by electric motors 900 so as to convey and transfer materials therebetween. It is also understood that the extensions and retractions of the above described piston/cylinder combinations 160, 342, 344, 630, 856, 878 are controlled in a conventional manner. These assemblies may be remotely controlled by a control station 910 or through direct electrical connections 920. Moreover, the unrolling of the package material from bolts 800 and 802 so as to present sheets 800*a* and 802*a* may be automatically or directly controlled.

In operation, the conveyor belt assembly 300 is positioned at its first position wherein the belt 310 and underlying plate 340 close the bottom aperture 120 of the tower 100. The loose particulate matter is deposited through aperture 130 and will fall to the bottom of the tower atop the belt 310. At this position the compression plate 200 is above the intake aperture 130 so as to preclude interference with the incoming particulate.

Upon a select amount of material being fed into the tower 100 the piston/cylinder combination is operated so as to move the compression plate 200 into a dwelling, tamping relationship atop the particulate matter. The compression presented by the combination of the compression and support plates 200, 340 and the surrounding tower walls forms a cube 1000 of the particulate material. It is understood that the amount of material deposited and the dwelling relationship of the compression plate 200, relative to the support plate 340, may be adjusted so as to regulate the height of bulk 1000 while the length and width thereof remaining fixed. Subsequent to formation, the operation of the piston/cylinder combinations 342, 344, along with the downward pressure of plate 200, displaces the conveyor assembly 300 with bulk 1000 thereon to a position below the bottom of the tower. The conveyor belt 310, at this ground adjacent position, then transfers the material bulk 1000 to the subsequent conveyor 550 and then to the packaging station 500.

During this latter transfer, the bulk 1000 is conveyed to a first ground adjacent position atop first portion 610 of the lower conveyor belt assembly 600 and then raised to a second position in which the bulk is compressed between first portions 610, 710. The bulk 1000 then passes through second portions 650, 750 of lower 600 and upper 700 conveyor belt assemblies across the diminished longitudinal gap and through the spanning sheet so that the sheet envelops the material bulk, the slack being minimized by tension spring/dancer combinations 880 and shifting of the second position away from the first positions so as to enhance the envelopment. Moreover the contact of the conveyor belt assemblies 650, 750 with the lower and upper surfaces of bulk 1000 further aids in bulk conveyance and sheet envelopment. Also, this conveyor belt 650, 750 contact precludes the compressed bulk 1000 from expansion towards its original non-compressed volume. Thus, the desired package height is maintained. The second portions 650, 750 then convey this bulk 1000, as enveloped by the packaging material, to a subsequent downstream station for palletization. A subsequent span of packaging sheets 800*a*, 802*a* may then be unrolled from bolts 800, 802 for enveloping the next bulk 1000 formed in tower 100.

I have found that the use of the vertical tower 100 presents a material bulk 1000 which is efficiently formed. The downstream conveyance of the material bulk 1000 by the above combination of conveyor assemblies precludes the need to ram induce the horizontal movement of the material bulk 1000. Thus, the elimination of frictional force diminishes, if not precludes, the separation of particulate matter from the material bulk 1000 and/or the formation of fibrous lumps therein. Moreover, the presentation of the material sheets 800*a*, 802*a* precludes the need to utilize separate bags and avoids the associated expenses thereof. Accordingly, elimination of the particulate material loss along with the cost effective use of packaging material presents an efficient system for the formation and packaging of particulate materials into a bulk form. In addition, the additional compression of the bulk material 1000 immediately prior to packaging, as well as the longitudinal shifting of the conveyor assemblies, enhances palletization of the particulate packages.

It is to be understood that while a certain form of this invention has been illustrated and described, it is not limited thereto except insofar as such limitations are included in the following claims and allowable functional equivalents thereof.

What is claimed is:

1. A system for forming and packaging particulate material in a bulk form comprising:

a compression tower comprising:

a chamber presented by a series of walls;

a ram assembly in said chamber having a first position adjacent a top of said tower and selectably extendable to a second position adjacent a lower end of said tower;

an opening at said lower end of said tower;

first conveyor means presenting a conveyor surface for forming a base of said tower, said first conveyor means movable between a first position wherein said surface closes said opening and a second position wherein said surface is downwardly displaced from said opening of said tower;

an inlet in said tower adapted for deposit of particulate material therein, the deposited material falling upon said first conveyor means surface at said first position, an extension of said ram to said second position adapted for compressing the material into a bulk form atop said conveyor means surface, the bulk being displaced below said tower upon said movement of said first conveyor means surface to said second position downwardly displaced from said opening of said tower, said first conveyor means including a conveyor belt for moving the bulk downstream of said tower;

a downstream framework including:

a second conveyor means having a first position longitudinally adjacent said conveyor belt of said first conveyor means;

a third conveyor means vertically displaced from said second conveyor means to present a space for receipt of the bulk therebetween; and means for regulating said space between said second and third conveyor means according to a height of the bulk whereby to further compress the bulk, an operation of said second and third conveyor means directing the material downstream.

2. The system as claimed in claim 1 further comprising:

a fourth conveyor means downstream said second conveyor means;

a fifth conveyor means vertically displaced from said forth conveyor means to present a space for receipt of said material bulk therebetween, said fourth and fifth conveyor means longitudinally spaced from said second and third conveyor means to present a longitudinal gap therebetween;

a sheet of packaging material traversing said gap between said longitudinally adjacent conveyor means, an operation of said second and third conveyor means transferring the compressed material bulk across said gap between said second and fourth conveyor means and through said packaging material sheet for envelopment thereby, said material bulk with said packaging material thereon conveyed to a downstream location by said fourth and fifth conveyor means.

3. The system as claimed in claim 2 further comprising:

means for regulating said longitudinal gap between at least said second and fourth longitudinally adjacent conveyor means.

4. The system as claimed in claim 1 wherein said space regulating means comprises:

at least one piston/cylinder assembly associated with said second conveyor means including a piston and rod connected to said downstream framework;

at least one strut connected to said rod of said at least one piston/cylinder assembly;

means for slidably mounting said strut in up and down movement on said framework;

means for connecting said second conveyor means to said strut, said rod of said piston/cylinder assembly reciprocatively movable in up and down directions wherein said strut and connected second conveyor means is moveable between said first position and a second position corresponding to a desired space from said third conveyor means.

5. The system as claimed in claim 3 wherein said means for regulating said gap between said at least second and fourth conveyor means comprises:

at least one rocker arm having a first end pivotally connected to said framework and a second end connected to said fourth conveyor means;

a piston/cylinder combination connected to said framework and including a reciprocative piston rod having one end connected to said at least one rocker arm, said piston rod of said piston/cylinder assembly reciprocatively movable for pivoting said at least one rocker arm and moving said fourth conveyor means connected thereto, said fourth conveyor means movement varying a breadth of said longitudinal gap between said second and fourth conveyor means.

6. The system as claimed in claim 4, wherein said connecting means comprises a bracket connected to said second conveyor means with said slidable mounting means comprising:

at least one pair of vertical spaced apart rods in said framework, said strut between said vertical rods;

a pair of flanges on said at least one bracket and slidable along said rods upon said movement of said strut by said piston/cylinder assembly.

7. The system as claimed in claim 4, wherein said connecting means comprises first and second brackets connected to said second conveyor means with said slidable mounting means comprising:

first and second pairs of spaced apart vertical rods with one of said at least one strut between said rods;

a pair of flanges on each bracket and slidable along each pair of vertical rods upon said movement of said strut by said piston/cylinder assembly.

8. A system for downstream conveyance of a compressed material in a bulk form comprising:

a framework;

a first conveyor means mounted to said framework and presenting a conveyor surface for forming a base for supporting a compressed bulk form;

a second conveyor means mounted to said framework and vertically spaced from said first conveyor means for bearing against a top of the material bulk to maintain the compression relationship of the bulk form, said first and second conveyor means urging the bulk material downstream;

means for adjusting said vertical space between said first and second conveyor means corresponding to the height of the bulk form, whereby to again compress the bulk form on said conveyor surface of said first conveyor means;

a third conveyor means mounted to said framework and movable between a first position longitudinally spaced from said first conveyor means and a second position longitudinally adjacent said first conveyor means;

a fourth conveyor means mounted to said framework and movable between a first position longitudinally spaced from said second conveyor means and a second position longitudinally adiacent said second conveyor means, said fourth conveyor means vertically displaced from said third conveyor means corresponding to said vertical space between said first and second conveyor means to present a space for reception of the material bulk therebetween; and means for regulating said longitudinal space between said first and second and said third and fourth longitudinally spaced conveyor means.

9. A system as claimed in claim 8 further comprising:

a vertical sheet of packaging material traversing said longitudinal space between said conveyor means, an operation of said conveyor means transferring said material bulk from said first and second conveyor means to said third and fourth conveyor means, said operation directing said material bulk through said packaging material sheet for envelopment thereby for conveyance to a downstream location.

10. A system as claimed in claim 8 wherein said longitudinal space regulating means comprises:

at least one piston/cylinder assembly including a rod attached to said framework;

a plurality of rocker arms having a first end pivotally attached to said framework and a second end attached to said third or fourth conveyor means, said at least one piston/cylinder assembly attached to at least one of said rocker arms;

means for linking movement of said rocker arms attached to said third conveyor means to said rocker arms attached to said fourth conveyor means;

an extension of said rod from said cylinder pivoting said rocker arms in a first direction to move said third and fourth conveyor means towards said first and second conveyor means to reduce said longitudinal space between said first and second and third and fourth conveyor means, a retraction of said rod into said cylinder moving said third and fourth conveyor means in a direction to increase the longitudinal space between said first and second and third and fourth conveyor means.

11. A system as claimed in claim 8 wherein said vertical space adjusting means comprises:

at least one piston/cylinder assembly including a rod attached to said framework and said first conveyor means;

means for linking movement of said rod of said piston/cylinder assembly with said first conveyor means;

a movement of said rod moving said first conveyor in up or down directions relative to said second conveyor means, whereby to adjust said vertical space between said first and second conveyor means.

12. A method of conveying a bulk material in a compressed form comprising the steps of:

initially forming a supply of particulate material into a bulk form;

compressing said bulk form;

conveying said bulk form along a first surface to a second surface downstream from said first surface;

providing a third surface at a vertical distance above said second surface;

raising said second surface towards said third surface for further compression of said bulk material downstream between said second and third surfaces; conveying said compressed bulk material along said raised second surface;

providing a fourth surface movable between a first position longitudinally spaced from said second surface and a second position longitudinally adjacent said second surface;

providing a fifth surface movable between a first position longitudinally spaced from said third surface and a second position longitudinally adjacent said third surface; and transferring said bulk material to said downstream fourth surface when said fourth surface is in said second position, said fifth surface being a distance above said fourth surface, said distance between said fourth and fifth surfaces further compressing the bulk material.

13. A method as claimed in claim 12 further comprising the steps of:

traversing a sheet of packaging material across an end of said second and third surfaces;

conveying said bulk material through said packaging material for envelopment thereby; and transferring said enveloped material to said downstream fourth surface longitudinally displaced from said second surface.

14. A method as claimed in claim 13 further comprising the step of conveying said enveloped bulk material on said fourth surface to a downstream location.

15. The method as claimed in claim 12 further comprising the step of shifting said fourth surface towards said second surface upon said transfer to minimize said longitudinal displacement between said second and fourth surfaces.

16. A system for downstream conveyance of a compressed material in a bulk form comprising:

a framework;

a first conveyor means mounted on said framework and presenting a conveyor surface for forming a base for a compressed bulk form;

a second conveyor means mounted on said framework and vertically spaced from said first conveyor means for bearing against a top of the material bulk to maintain the compression relationship of the bulk form, said first and second conveyor means urging the bulk material downstream;

means for adjusting said vertical space between said first and second conveyor means corresponding to the height of the bulk form, whereby to again compress the bulk form received from the upstream conveyor assembly;

a third conveyor means longitudinally spaced from said first conveyor means;

a fourth conveyor means longitudinally spaced from said second conveyor means, said fourth conveyor means vertically displaced from said third conveyor means, said vertical displacement corresponding to said vertical space between said first and second conveyor means to present a space for reception of the material bulk therebetween;

at least one piston/cylinder assembly including a rod attached to said framework;

a plurality of rocker arms having a first end pivotally attached to said framework and a second end attached to said third or fourth conveyor means, said at least one piston/cylinder assembly attached to at least one of said rocker arms;

means for linking movement of said rocker arms attached to said third conveyor means to said rocker arms attached to said fourth conveyor means;

an extension of said rod from said cylinder pivoting said rocker arms in a first direction to move said third and fourth conveyor means towards said first and second conveyor means to reduce said longitudinal space between said first and second and said third and fourth conveyor means, a retraction of said rod into said cylinder moving said third and fourth conveyor means in a direction to increase the longitudinal space between said first and second and said third and fourth conveyor means.

17. A system as claimed in claim 16 further comprising a vertical sheet of packaging material traversing said longitudinal space between said conveyor means, an operation of said conveyor means transferring said material bulk from said first and second conveyor means to said third and fourth conveyor means, said operation directing said material bulk through said packaging material sheet for envelopment thereby for conveyance to a downstream location.

18. A system as claimed in claim 16 wherein said vertical space adjusting means comprises:

at least one piston/cylinder assembly including a rod attached to said framework and said first conveyor means;

means for linking movement of said rod of said piston/cylinder assembly with said first conveyor means;

a movement of said rod moving said first conveyor in up or down directions relative to said second conveyor means, whereby to adjust said vertical space between said first and second conveyor means.

* * * * *